US008460486B1

(12) United States Patent
Johnston et al.

(10) Patent No.: US 8,460,486 B1
(45) **Date of Patent: *Jun. 11, 2013**

(54) PERCUSSION PRIMER COMPOSITION AND SYSTEMS INCORPORATING SAME

(75) Inventors: Harold E. Johnston, Radford, VA (US); Kristin F. Warner, Ogden, UT (US); Reed J. Blau, Richmond, UT (US); Scott K. Lusk, Clarkston, UT (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/477,750

(22) Filed: May 22, 2012

Related U.S. Application Data

(60) Continuation of application No. 12/559,218, filed on Sep. 14, 2009, now Pat. No. 8,282,751, which is a division of application No. 11/093,633, filed on Mar. 30, 2005, now abandoned.

(51) Int. Cl.

| | |
|---|---|
| ***C06B 33/00*** | (2006.01) |
| ***C06B 33/08*** | (2006.01) |
| ***D03D 23/00*** | (2006.01) |
| ***D03D 43/00*** | (2006.01) |

(52) U.S. Cl.
USPC ..... 149/38; 149/37; 149/108.6; 149/109.2; 149/109.4

(58) Field of Classification Search
USPC ..... 149/46, 37, 38, 108.6, 109.2, 109.4
See application file for complete search history.

(56) References Cited

U.S. PATENT DOCUMENTS

| | | | | |
|---|---|---|---|---|
| 998,007 | A | 7/1911 | Imperiali | |
| 2,194,480 | A | 3/1940 | Pritham et al. | |
| 2,231,946 | A | 2/1941 | Rechel et al. | |
| 2,349,048 | A * | 5/1944 | Mackey et al. | 149/11 |
| 2,649,047 | A | 8/1953 | Silverstein | |

(Continued)

FOREIGN PATENT DOCUMENTS

| | | |
|---|---|---|
| DE | 2513735 | 10/1975 |
| DE | 19606237 | 8/1996 |

(Continued)

OTHER PUBLICATIONS

Nordblom et al., Frankford Arsenal Report No. R-206; The Stabilization of Commerical Red Phosphorus Final Report, Research Item No. 202.14, Frankford Arsenal Library. Apr. 1943.

(Continued)

*Primary Examiner* — James McDonough
(74) *Attorney, Agent, or Firm* — Christensen Fonder P.A.

(57) ABSTRACT

A percussion primer composition that comprises an explosive and a sensitizer, the explosive being a moderately insensitive explosive having an impact sensitivity in the range from about 0.3 kp m to about 0.75 kp m. The moderately insensitive explosive may comprise CL-20, PETN, RDX, HMX, or mixtures thereof. The sensitizer may comprise aluminum, titanium, zirconium, magnesium, melamine, styrene, lithium aluminum hydride, or mixtures thereof. In some instances, the percussion primer composition may comprise the moderately insensitive explosive precipitated onto the sensitizer. The percussion primer composition may contain an oxidizer, which in certain situations comprises a conventional oxidizer or a bismuth compound. The bismuth compound is bismuth trioxide, bismuth subnitrate, bismuth tetroxide, bismuth sulfide, or mixtures thereof. A gun cartridge and other primer-containing ordnance assemblies employing the percussion primer composition are also disclosed. Methods of forming the sensitized explosive and the percussion primer are also disclosed.

44 Claims, 4 Drawing Sheets

U.S. PATENT DOCUMENTS

| | | | | |
|---|---|---|---|---|
| 2,929,699 | A | 3/1960 | Audrieth et al. | |
| 2,970,900 | A | 2/1961 | Woodring et al. | |
| 3,026,221 | A | 3/1962 | Krist | |
| 3,113,059 | A | 12/1963 | Ursenbach | |
| 3,181,463 | A | 5/1965 | Morgan et al. | |
| 3,275,484 | A | 9/1966 | Foote et al. | |
| 3,367,805 | A | 2/1968 | Clay et al. | |
| 3,420,137 | A | 1/1969 | Staba | |
| 3,437,534 | A | 4/1969 | McEwan et al. | |
| 3,488,711 | A | 1/1970 | Dany et al. | |
| 3,634,153 | A | 1/1972 | Perkins et al. | |
| 3,650,856 | A | 3/1972 | Artz | |
| 3,707,411 | A | 12/1972 | Gawlick et al. | |
| 3,726,217 | A | 4/1973 | Dedman et al. | |
| 3,755,019 | A | 8/1973 | Huskins et al. | |
| 3,767,488 | A | 10/1973 | Seals | |
| 3,904,451 | A | 9/1975 | Rainone | |
| 4,014,719 | A | 3/1977 | Wells | |
| 4,133,707 | A | 1/1979 | Andrew | |
| 4,142,927 | A | 3/1979 | Walker et al. | |
| 4,145,969 | A | 3/1979 | Gawlick et al. | |
| 4,196,026 | A | 4/1980 | Walker et al. | |
| 4,304,614 | A | 12/1981 | Walker et al. | |
| 4,315,897 | A | 2/1982 | Staendeke et al. | |
| 4,336,085 | A | 6/1982 | Walker et al. | |
| 4,428,292 | A | 1/1984 | Riggs | |
| 4,522,665 | A | 6/1985 | Yates, Jr. et al. | |
| 4,554,031 | A | 11/1985 | Kerviel et al. | |
| 4,581,082 | A | 4/1986 | Hagel et al. | |
| 4,698,215 | A | 10/1987 | Albanesi et al. | |
| 4,728,375 | A | 3/1988 | Simpson | |
| 4,853,288 | A | 8/1989 | Staendeke et al. | |
| 4,963,201 | A | 10/1990 | Bjerke et al. | |
| 4,976,793 | A | 12/1990 | Zimmerman | |
| 5,027,707 | A | 7/1991 | Mei | |
| 5,167,736 | A | 12/1992 | Mei et al. | |
| 5,216,199 | A | 6/1993 | Bjerke et al. | |
| 5,316,600 | A | 5/1994 | Chan et al. | |
| 5,388,519 | A | 2/1995 | Guindon et al. | |
| 5,417,160 | A | 5/1995 | Mei et al. | |
| 5,449,423 | A | 9/1995 | Cioffe | |
| 5,466,315 | A | 11/1995 | Erickson et al. | |
| 5,522,320 | A | 6/1996 | Dillehay | |
| 5,557,061 | A | 9/1996 | Ramaswamy | |
| 5,567,252 | A | 10/1996 | Mei et al. | |
| 5,610,367 | A | 3/1997 | Erickson et al. | |
| 5,672,219 | A | 9/1997 | Rinaldi et al. | |
| 5,684,268 | A | 11/1997 | Lopata | |
| 5,717,159 | A | 2/1998 | Dixon et al. | |
| 5,780,768 | A | 7/1998 | Knowlton et al. | |
| 5,831,208 | A | 11/1998 | Erickson | |
| 5,939,661 | A | 8/1999 | Bayliss | |
| 6,057,264 | A | 5/2000 | Bradbury | |
| 6,066,214 | A | 5/2000 | Comfort | |
| 6,165,294 | A | 12/2000 | Fogelzang et al. | |
| 6,322,648 | B2 | 11/2001 | Rayer et al. | |
| 6,478,903 | B1 | 11/2002 | John, Jr. et al. | |
| 6,544,363 | B1 | 4/2003 | Erickson | |
| 6,581,520 | B1 | 6/2003 | Koch et al. | |
| 6,588,344 | B2 | 7/2003 | Clark et al. | |
| 6,612,242 | B2 | 9/2003 | Raupp et al. | |
| 6,620,267 | B1 | 9/2003 | Guindon et al. | |
| 6,641,683 | B1 | 11/2003 | McKenney, Jr. et al. | |
| 6,645,625 | B2 | 11/2003 | Horold et al. | |
| 6,663,731 | B1 | 12/2003 | Rose et al. | |
| 6,878,221 | B1 * | 4/2005 | Mei et al. | 149/41 |
| 7,129,348 | B1 | 10/2006 | Wardle et al. | |
| 7,192,649 | B1 | 3/2007 | Jouet et al. | |
| 7,670,446 | B2 | 3/2010 | Puszynski et al. | |
| 7,670,466 | B2 * | 3/2010 | Lee | 204/224 M |
| 8,192,568 | B2 | 6/2012 | Erickson et al. | |
| 8,202,377 | B2 * | 6/2012 | Erickson et al. | 149/109.6 |
| 8,206,522 | B2 | 6/2012 | Sandstrom et al. | |
| 2002/0127403 | A1 | 9/2002 | Horold et al. | |
| 2002/0129724 | A1 * | 9/2002 | Clark et al. | 102/307 |
| 2005/0183805 | A1 | 8/2005 | Pile et al. | |
| 2005/0189053 | A1 * | 9/2005 | Pile et al. | 149/108.6 |
| 2005/0224147 | A1 | 10/2005 | Jung et al. | |
| 2006/0060273 | A1 | 3/2006 | Smith | |
| 2006/0113014 | A1 * | 6/2006 | Puszynski et al. | 149/40 |
| 2006/0219341 | A1 | 10/2006 | Johnston et al. | |
| 2006/0272756 | A1 | 12/2006 | Kneisl et al. | |
| 2007/0102076 | A1 | 5/2007 | Redecker et al. | |
| 2008/0245252 | A1 * | 10/2008 | Erickson et al. | 102/204 |
| 2010/0116385 | A1 | 5/2010 | Johnston et al. | |
| 2011/0000390 | A1 | 1/2011 | Erickson et al. | |
| 2011/0239887 | A1 | 10/2011 | Sandstrom et al. | |

FOREIGN PATENT DOCUMENTS

| | | |
|---|---|---|
| EP | 0070932 | 2/1983 |
| EP | 0283759 | 9/1988 |
| EP | 0334725 | 9/1989 |
| EP | 0699646 | 3/1996 |
| EP | 0911366 | 4/1999 |
| EP | 0952130 | 10/1999 |
| EP | 1195366 | 4/2002 |
| EP | 1443034 | 8/2004 |
| EP | 0737174 | 9/2004 |
| WO | WO9515298 | 6/1995 |
| WO | WO9612770 | 5/1996 |
| WO | WO9944968 | 9/1999 |
| WO | WO0121558 | 3/2001 |
| WO | WO0206421 | 1/2002 |
| WO | WO2006009579 | 1/2006 |
| WO | WO2006083379 | 8/2006 |
| WO | WO2008/100252 | 8/2008 |
| WO | WO2009/079788 | 7/2009 |
| WO | WO2009/102338 | 8/2009 |
| WO | WO2011/123437 | 10/2011 |

OTHER PUBLICATIONS

United States Army, Small Caliber Ammunition Test Procedures 5.56 mm Cartridges, Picatinny Arsenal, New Jersey, Nov. 1998. pp. 1-191.

Eisentrager, Frank, "Key Parameters for the Stability of Red Phosphorous", 31st International Pyrotechnic Seminar Proceedings, Jul. 2004. Colorado Springs, Colorado. Copyright 2000 IPSUSA.

Ratcliff, Andrew, "Review of Six Generations of Red Phosphorous 1950-1999 and Beyond", 27th International Pyrotechnic Seminar Proceedings, Jul. 2000. Grand Junction Colorado. Copyright 2000. IPSUSA.

Horoeld et al, "Commerical Developments in Red Phosphorous Performance and Stability for Pyrotechnics", Journal of Pyrotechnics, Issue 12. Summer 2001. Copyright 2001. IPS.

Collins et al., "The Use of Red Phosphorous in Pyrotechnics—Results of an International Investigation". 31st International Pyrotechnics Seminar Proceedings. Jul. 2004. Colorado Springs, Colorado. Copyright 2002. IPSUSA.

European Search Report for European Application No. EP07004155 dated Jul. 16, 2007.

Alenfelt, "Corrosion protection of magnesium without the use of chromates", Pyrotechnica XVI (Aug. 1995), pp. 44-49. Pyrotechnia Publications, Austin, Texas.

Muller, "Citric acid as corrosion inhibitor for aluminum pigment", Corrosion Science, vol. 46, No. 1. Jan. 2004. p. 159-167.

International Search Report and Written Opinion of International Application No. PCT/US2008/068275 date of mailing Jan. 13, 2009.

International Search Report and Written Opinion of International Application No. PCT/US2007/003806 date of mailing Jan. 13, 2009.

European Office Action of European Application No. 07870653.8 dated Feb. 21, 2011.

Canadian Office Action of Canadian Application No. 2668123 dated Aug. 15, 2011.

Busky, et al., "Non-Toxic Heavy Metal Free Primers for Small Arms Cartridges—Red Phosphorous Base", presented May 8, 2007.

Definition of "composition", Hackh's Chemical Dictionary, 4th Edition. Copyright 1969 by Mc-Graw Hill, Inc. New York, NY.

Definition of "mixture", The American Heritage College Dictionary, 3rd Edition. Copyright 2000 by Houghton Mifflin.

Horold, Sebastian, "Improvements in Stability of Red Phosphorous", 27th International Pyrotechnic Seminar Proceedings, Jul. 2000, Grand Junction Colorado, Copyright 2000 IPSUSA.

Levitas, Valery I, et al., "Mechanochemical mechanism for fast reaction of metastable intermolecular composites based on dispersion of liquid metal", J. Appl. Phys. vol. 101, pp. 083524-1 through 083524-20, 2007.
Railsback, Bruce, "An Earth scientist's periodic table of the elements and their ions, "Geology, pp. 737-740, Sep. 2003.
Railsback, Bruce, "An earth scientist's periodic table of the elements and their ions," Version 4.8, University of Georgia, Athens, Georgia, Copyright 2007. http://www.gly.uga.edu/railsback/PT.html.
Rovner, Sophie, "How a Lubricant Additive Works", chemical & Engineering News, vol. 83, No. 11, p. 10 Copyright 2005.
Ostrowski et al., "AL/MoO3 Primer Evaluation Tests Part II: Delay Cartridges,"American Institute of Aeronautics and Astronautics, AIAA/ASME/SAE/ASEE Joint Propulsion Conference, Huntsville, AL 2000. Paper 2000-3647.
Ostrowski et al., "Recent Accomplishments in MIC Primer Development at NSWC/Indian Head," Paper 2005-3514, AIAA 41st Joint Propulsion Conference, Tucson, AZ 2005.
Ostrowski et al., "Nano Energetics for US Navy Percussion Primer Applications", Energetic Materials Technology. pp. 1-6. 2006.
Stevenson et al., Frankford Arsenal Report No. R-265; Caliber .30 Red Phosphorus Primers, Third Report Research Item No. 204.0, Frankfort Arsenal Library, Feb. 1943.
Application and File History for U.S. Appl. No. 12/751,607, filed Mar. 31, 2010, inventor Sandstrom et al.
Application and File History for U.S. Appl. No. 12/029,084, filed Feb. 11, 2008, inventor Erickson.
Application and File History for U.S. Appl. No. 11/704,530, filed Feb. 9, 2007, inventor Erickson.
Application and File History for U.S. Appl. No. 12/559,218, filed Sep. 14, 2009, inventor Johnston.
Application and File History for U.S. Appl. No. 11/093,633, filed Mar. 30, 2005, inventor Johnston.

* cited by examiner

PERCUSSION PRIMER COMPOSITION AND SYSTEMS INCORPORATING SAME

RELATED APPLICATION

This application is a continuation of application Ser. No. 12/559,218 filed Sep. 14, 2009, now U.S. Pat. No. 8,282,751, which in turn is a division of application Ser. No. 11/093,633 filed Mar. 30, 2005, now abandoned, each of which is hereby fully incorporated herein by reference.

FIELD OF THE INVENTION

The present invention relates to a percussion primer composition that is nontoxic, noncorrosive, and nonhygroscopic. More specifically, the present invention relates to a percussion primer composition that includes a moderately insensitive explosive, a sensitizer, and an oxidizer, as well as to ordnance and systems incorporating such a percussion primer composition.

BACKGROUND OF THE INVENTION

A percussion primer is a primary explosive composition that is commonly used to ignite a secondary explosive composition or charge. The primary explosive composition is more sensitive to impact than the secondary explosive composition and burns or deflagrates for a short period of time before detonating. To be effective as a percussion primer, the primary explosive composition must have a relatively low activation energy for a given output energy. In contrast, conventional explosives and insensitive explosives with similar output energies have higher activation energies. Since the primary explosive composition is more sensitive to impact, the primary explosive composition ignites and detonates before the secondary explosive composition. In contrast, the secondary explosive composition is relatively stable and does not detonate until initiated by the primary explosive composition.

Many ingredients of conventional percussion primers are toxic and their use is restricted by the Environmental Protection Agency. These ingredients include styphnate and picrate salts, heavy metal compounds, or diazodinitrophenol ("DDNP" or dinol). The heavy metal compounds include compounds of mercury, lead, barium, antimony, beryllium, cesium, cadmium, arsenic, chromium, selenium, strontium, tin, or thallium, such as lead styphnate or barium styphnate, or mercury fulminate. Upon ignition, a percussion primer that includes one of these ingredients emits toxic lead oxides or toxic compounds of other heavy metals, such as oxides of cesium, barium, antimony, or strontium. DDNP is also toxic because it is known to cause allergic reactions and is possibly carcinogenic.

Conventional percussion primers also commonly include oxidizers, such as potassium nitrate, potassium perchlorate, or potassium chlorate, which are also toxic. Potassium nitrate and potassium chlorate are also hygroscopic, which increases the complexity of processing the percussion primer because the potassium nitrate and potassium chlorate must be stored in ovens and cannot be used on wet days. In addition to requiring specialized storage, hygroscopic materials cause the percussion primer to have a sticky consistency, which affects loading and processing of the percussion primer. Other hygroscopic ingredients, such as gums, are also used in conventional percussion primers. Gums typically gain about 30% of the gum weight in moisture when exposed to humid conditions. In addition to being hygroscopic, gums are obtained from natural sources and, therefore, exhibit characteristics which may vary from batch to batch. Some ingredients of conventional percussion primers are also corrosive, such as potassium chlorate, which is corrosive to steel and corrodes a gun barrel when the percussion primer is used in small arms ammunition.

To reduce health and environmental risks, percussion primers that are free of lead have been developed. U.S. Pat. No. 4,522,665 to Yates, Jr. et al. discloses a percussion primer that includes titanium and potassium perchlorate. U.S. Pat. No. 5,417,160 to Mei et al. discloses a percussion primer that contains calcium silicide, DDNP, and an alkaline or alkaline earth nitrate. U.S. Pat. No. 5,167,736 to Mei et al. discloses a percussion primer that includes DDNP and boron and U.S. Pat. No. 5,567,252 to Mei et al. discloses a percussion primer that includes DDNP, boron, and iron oxide. U.S. Pat. Nos. 4,963,201 and 5,216,199 to Bjerke et al. disclose a percussion primer that includes DDNP, strontium nitrate, tetracene, and a nitrate ester fuel. U.S. Pat. No. 6,478,903 to John, Jr. et al. discloses a percussion primer that includes bismuth sulfide and potassium nitrate or zinc sulfide and aluminum nitrate. U.S. Pat. No. 4,581,082 to Hagel et al. discloses a primer charge that includes zinc peroxide, DDNP, and/or a strontium salt of mono- and/or dinitrodihydroxydiazobenzene.

International Application WO 01/21558 to Nesveda et al. discloses an ignition mixture that includes a high explosive and a sensibilizer, such as tetracene, tetrazole, a tetrazole derivative, or a tetrazole salt. The high explosive is a nitroester, such as penthrite, nitrocellulose, or hexanitromanite, or a nitramine, such as hexogen ("RDX"), octogen ("HMX"), or tetryl. The ignition mixture also includes powdered boron as a fuel and an oxidizing agent, such as an oxide of copper, bismuth, zinc, iron, manganese, vanadium, tin, molybdenum, or calcium.

In light of the problems mentioned above with conventional percussion primers, it would be desirable to produce a percussion primer that utilizes nontoxic, noncorrosive, and nonhygroscopic ingredients.

SUMMARY OF THE INVENTION

The present invention relates to a sensitized explosive that comprises an explosive precipitated onto a sensitizer. The explosive is selected from the group consisting of 2,4,6,8,10,12-hexanitro-2,4,6,8,10,12-hexaazatetracyclo[5.5.0.$0^{5,9}0^{3,11}$]-dodecane ("CL-20"), pentaerythritol tetranitrate ("PETN"), cyclo-1,3,5-trimethylene-2,4,6-trinitramine ("RDX"), cyclotetramethylene tetranitramine ("HMX"), and mixtures thereof. The sensitizer is selected from the group consisting of aluminum, aluminum oxide, titanium, zirconium, magnesium, boron, silicon, melamine, styrene, lithium aluminum hydride, calcium silicide, and mixtures thereof. The explosive may comprise from approximately 70% by weight ("wt %") to approximately 99.5 wt % of a total weight of the sensitized explosive and the sensitizer may comprise from approximately 0.5 wt % to approximately 30 wt % of the total weight of the sensitized explosive. The sensitized explosive may have a particle size that ranges from approximately 1 μm to approximately 100 μm.

The present invention also relates to a percussion primer that comprises a sensitized explosive, a bismuth compound, and a melt binder, wherein the sensitized explosive comprises an explosive precipitated onto a sensitizer. The explosive may have an impact sensitivity that ranges from approximately 0.3 kp m to approximately 0.75 kp m. The explosive and the sensitizer may be one of the compounds previously described and may be present in the amounts indicated above. The bismuth compound may be bismuth oxide, bismuth subnitrate, bismuth tetroxide, bismuth sulfide, or mixtures thereof. The melt binder may be a wax having a melting point above ambient temperature, trinitrotoluene, poly(3,3-bis(azidomethyl)oxetane), poly(3-azidomethyl-3-methyloxetane), ethyl-3,5-dinitrobenzoate, 1,3,3-trinitroazetine, natural gums, or mixtures thereof.

The sensitized explosive may comprise from approximately 35 wt % to approximately 55 wt % of a total weight of the percussion primer, the bismuth compound may comprise from approximately 20 wt % to approximately 75 wt % of the total weight of the percussion primer, and the melt binder may comprise from approximately 0.5 wt % to less than approximately 20 wt % of the total weight of the percussion primer. The percussion primer may further comprise at least one of ground glass, nitrocellulose, and tetracene.

The present invention also relates to a method of producing the sensitized explosive that comprises precipitating an explosive onto a sensitizer. The explosive is selected from the group consisting of CL-20, PETN, RDX, and HMX and the sensitizer is selected from the group consisting of aluminum, aluminum oxide, titanium, zirconium, magnesium, boron, silicon, melamine, styrene, lithium aluminum hydride, calcium silicide, and mixtures thereof. To precipitate the explosive, the explosive may be dissolved in a solvent, the sensitizer added to the solvent, and the solvent removed, forming crystals of the sensitized explosive. The crystals may have a particle size that ranges from approximately 1.0 μm to approximately 100 μm.

The present invention also relates to a method of producing the percussion primer that comprises providing a sensitized explosive and combining the sensitized explosive with a bismuth compound and a melt binder. The sensitized explosive is produced as described above. The bismuth compound and the melt binder are as described above.

The present invention also relates to a gun cartridge that comprises a casing in which a percussion primer and a secondary explosive composition are disposed. The percussion primer is as described above. The gun cartridge may be a centerfire gun cartridge or a rimfire gun cartridge.

The present invention also relates to primer-containing ordnance assemblies comprising a housing in which a percussion primer and a secondary explosive composition are disposed. The percussion primer is as described above. The primer-containing ordnance assembly may be (without limitation) a grenade, mortar, detcord initiator, mortar round, rocket motor, or other system including a percussion primer and secondary explosive composition, alone or in combination with a propellant.

BRIEF DESCRIPTION OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE DRAWINGS

Figure 1:
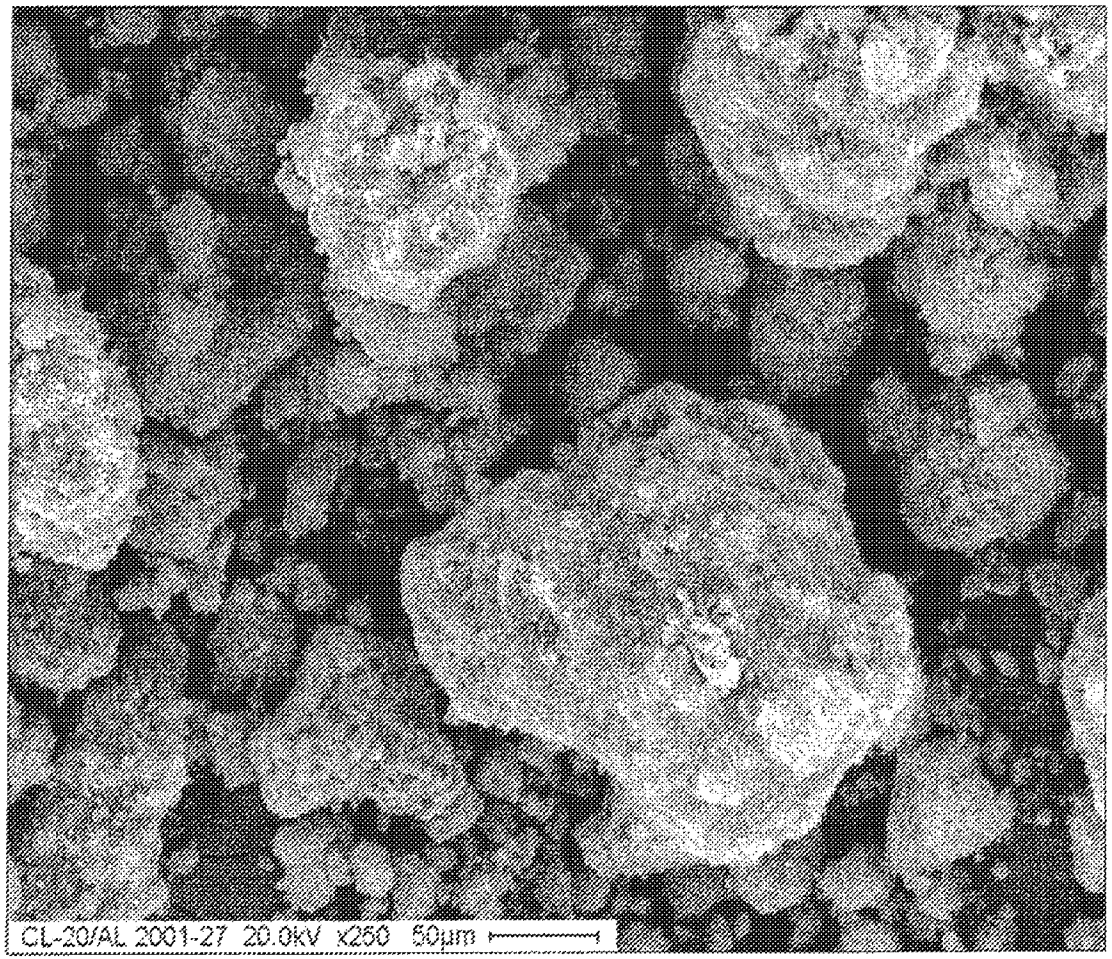
FIG. 1 is a scanning electron micrograph of crystals of CL-20 sensitized with aluminum.

An explosive composition for use as a percussion primer is disclosed. As used herein, the term "percussion primer" refers to an explosive composition that detonates under slight percussion. For instance, the percussion primer may be initiated by heat, shock waves, or a combination of heat and shock waves. Upon ignition, the percussion primer may generate heat, but little gas, and condensing hot particles that are of sufficient energy to ignite a secondary explosive composition or charge. The percussion primer of the present invention utilizes ingredients that are low in toxicity, free of heavy metals, stable to aging, nonhygroscopic, and noncorrosive. When combusted, the percussion primer may produce nontoxic, nonhygroscopic, and noncorrosive combustion products. The percussion primer may also be highly reliable in that the percussion primer reliably ignites the secondary explosive composition over ambient temperature extremes.

The percussion primer includes a sensitized explosive, an oxidizer, and a melt binder. The sensitized explosive may include an explosive and a sensitizer. As used herein, the term "sensitized explosive" refers to an explosive that is rendered more sensitive to impact and friction by association with the sensitizer than the explosive alone (the unsensitized explosive). The sensitized explosive of the present invention may provide substantially the same impact sensitivity to the percussion primer as lead styphnate provides to a conventional percussion primer. The explosive may be a solid material that is moderately insensitive to impact and that decomposes upon melting. For instance, the explosive may have an impact sensitivity that ranges from approximately 0.3 kp m to approximately 0.75 kp m. Examples of explosives suitable for use in the percussion primer of the present invention include, but are not limited to, CL-20, PETN, RDX, HMX, or mixtures thereof. The explosive may have a particle size that ranges from approximately 0.1 μm to approximately 100 μM, with an average particle size that ranges from approximately 20 μm to approximately 50 μm. The explosive may have a bimodal or trimodal particle size distribution. However, the explosive used in the percussion primer is not limited to a particular particle size or particle size range because the explosive is dissolved in a solvent as the sensitized explosive is prepared. An explosive that is highly sensitive to impact may be undesirable for use in the percussion primer because the explosive may unexpectedly initiate, such as without an impact event. However, an explosive that is not sufficiently impact sensitive may also be undesirable because the explosive may not initiate upon impact, even if sensitized by the sensitizer.

Since the explosive used in the percussion primer is moderately insensitive, the sensitizer may be used to increase the sensitivity of the explosive. The explosive may be sensitized to impact by precipitating the explosive onto the sensitizer, as described below. The sensitizer may be a solid material that is thermally stable and does not oxidize. For instance, the sensitizer may be an electron rich compound or a reducing agent. Examples of materials that may be used as the sensitizer include, but are not limited to, aluminum, aluminum oxide, titanium, zirconium, magnesium, boron, silicon, melamine, styrene, lithium aluminum hydride, calcium silicide, or mixtures thereof. The sensitizer may be selected based on the sensitivity of the explosive and the intended use of the percussion primer. The sensitizer may have a bimodal particle size distribution and have a particle size that ranges from approximately 0.1 μm (approximately 100 nm) to approximately 100 μm.

If the sensitizer is aluminum, the aluminum may have an average particle size that ranges from approximately 0.1 μm to approximately 5 μm. For the sake of example only, Alex®, which is a nanoaluminum powder having a particle size that ranges from approximately 100 nm to approximately 600 nm and having an average particle size of approximately 210 nm, may be used. Alex® is available from Argonide Corp. (Sanford, Fla.). The H-series (H-2, H-3, or H-5) of powdered aluminum, which is available from Valimet, Inc. (Stockton, Calif.), may also be used in the percussion primer. The powdered H-2 aluminum has an average particle size of approximately 2 μm, the powdered H-3 has an average particle size of approximately 3 μm, and the powdered H-5 has an average particle size of approximately 5 μm. Nanosized aluminum may also be used and is available from Nanotech (Austin, Tex.). The particle size of the aluminum used in the percussion primer may be selected based on the intended purpose of the percussion primer. For instance, if the percussion primer is to be used in small arms ammunition, aluminum having a small particle size, such as Alex®, may be used. If larger particle size aluminum is used in the small arms ammunition, the percussion primer may be too brisant for its intended purpose. However, to dilute or reduce the brisance, an inert filler may optionally be present in the percussion primer. The inert filler enables a percussion primer that may otherwise be too brisant to be used in small arms ammunition. Aluminum having the larger particle size, up to approximately 5 μm, may be used without dilution in other applications, such as in larger ordnance. If the sensitizer is melamine, the melamine may have a particle size that ranges from approximately 2 μm to approximately 100 μm, with an average particle size of approximately 12 μm. Melamine is commercially available from numerous sources, such as from Sigma-Aldrich Co. (St. Louis, Mo.).

The explosive may account for from approximately 70% by weight ("wt %") to approximately 99.5 wt % of a total weight of the sensitized explosive. The sensitizer may constitute from approximately 0.5 wt % to approximately 30 wt % of the total weight of the sensitized explosive. In one embodiment, the sensitized explosive includes approximately 85 wt % CL-20 and approximately 15 wt % aluminum or approximately 15 wt % melamine. In another embodiment, the sensitized explosive includes approximately 77.5 wt % CL-20 and approximately 22.5 wt % aluminum. In another embodiment, the sensitized explosive includes approximately 70 wt % CL-20 and approximately 30 wt % aluminum or approximately 30 wt % melamine. In another embodiment, the sensitized explosive includes approximately 70 wt % RDX and approximately 30 wt % aluminum. In another embodiment, the sensitized explosive includes approximately 70 wt % PETN and approximately 30 wt % aluminum or approximately 30 wt % melamine.

The sensitized explosive may be formed by precipitating the explosive onto the sensitizer. For instance, the explosive may be dissolved into a solvent, into which the sensitizer is also added. The solvent may be any volatile solvent in which the explosive is soluble. The solvent may be a polar, organic solvent including, but not limited to, ethyl acetate, acetone, or mixtures thereof. When the sensitized explosive is to be used in the percussion primer, the solvent may be evaporated, such as by using heat, reduced pressure, or combinations thereof. As the solvent evaporates, the explosive may precipitate onto the sensitizer, producing crystals of the sensitized explosive. The crystals may be of a sufficiently small size for the sensitized explosive to be loaded into the desired ordnance without damaging the crystals. The crystals of the sensitized explosive may have an average particle size that ranges from approximately 1 μm to approximately 100 μm. Crystals of CL-20 sensitized with aluminum are shown in FIG. 1. The CL-20 in the crystals precipitated as the epsilon-polymorph ("δ-polymorph"), the most stable form of CL-20, as determined by Fourier Transform Infrared Spectroscopy (data not shown).

Alternatively, the explosive may be dissolved into the solvent and the sensitizer may be added to a nonsolvent, forming a slurry of the sensitizer in the nonsolvent. The nonsolvent may be any nonpolar organic solvent in which the sensitizer is not soluble, such as hexane, heptane, octane, or mixtures thereof. The solution of the explosive may be combined with the slurry of the sensitizer. When the sensitized explosive is to be formulated into the percussion primer, the solvent and the nonsolvent may be removed, such as by using heat, reduced pressure, or combinations thereof, to precipitate the explosive onto the sensitizer. However, until the sensitized explosive is to be used in the percussion primer, the sensitized explosive may remain in the solvent or the solvent and the nonsolvent. Without being bound to a particular theory, it is believed that precipitating the explosive onto the sensitizer brings the explosive and sensitizer into intimate contact, which reduces the activation energy of the explosive. As such, the sensitized explosive may be more sensitive to impact than the explosive alone (the unsensitized explosive) and may utilize less energy to initiate than is needed to initiate the unsensitized explosive.

While the sensitivity of the sensitized explosive is increased, the sensitized explosive may remain safe to handle. Since the solvent or solvent and nonsolvent are not removed until the sensitized explosive is ready to be formulated into the percussion primer, the sensitized explosive is stored in a substantially wet state and not a substantially dry state. As used herein, the term "dry" refers to a state of the sensitized explosive that is free of solvent or solvent and nonsolvent. In contrast, a "wet" state refers to a state in which the sensitized explosive is present in the solvent or in the solvent and nonsolvent. Since the sensitized explosive remains wetted by the solvent or solvent and nonsolvent, particles of the sensitized explosive may have insufficient surface area to burn. As such, the wet, sensitized explosive may only be capable of a surface burn. When the sensitized explosive is to be used in the percussion primer, a desired amount of the wet, sensitized explosive may be dried, such as by removing the solvent or solvent and nonsolvent. Since large or bulk quantities of the wet, sensitized explosive are not dried, the sensitized explosive may be safe to handle in the amounts that are needed in the percussion primer.

Depending on the intended purpose of the percussion primer and the desired properties of the percussion primer, the oxidizer may be a bismuth compound or a conventional oxidizer. While the bismuth compound may be considered a less effective or weaker, oxidizer than the conventional oxidizer, the bismuth compound, in combination with the sensitized explosive, may provide the desired properties to the percussion primer. In other words, the increased sensitivity of the sensitized explosive may be balanced by the reduced oxidizing effect of the bismuth compound. Examples of bismuth compounds suitable for use in the percussion primer include, but are not limited to, bismuth oxide ("$Bi_2O_3$"), bismuth subnitrate ("$BiONO_3$"), bismuth tetroxide ("$Bi_2O_4$"), or mixtures thereof. These bismuth compounds are nontoxic, noncorrosive, and nonhygroscopic. Therefore, the bismuth compound may be used as the oxidizer when the resulting percussion primer is to be noncorrosive or nonhygroscopic.

For instance, the bismuth compound may be used as the oxidizer when the percussion primer is to be used in a gun cartridge, such as in centerfire ammunition or in rimfire ammunition. Since the bismuth compound is noncorrosive, combustion products of the percussion primer may not corrode the gun barrel. In addition, the bismuth compound may decompose upon combustion to form metallic bismuth, which may provide lubrication in the gun barrel, similar to the effect produced by lead oxide in metallic lead percussion primers. Bismuth sulfide, or mixtures of bismuth sulfide and at least one of the previously discussed bismuth compounds, may be used as the bismuth compound in situations where corrosiveness is not a concern, such as in grenades.

If hygroscopicity or corrosiveness of the percussion primer is not a concern, the conventional oxidizer may be used, such as a salt or metal salt of a nitrate, chlorate, or perchlorate. For the sake of example only, the conventional oxidizer may be barium nitrate, cesium nitrate, potassium nitrate, ammonium nitrate, potassium chlorate, potassium perchlorate, ammonium perchlorate, or mixtures thereof. The conventional oxidizer may also be a metal oxide, metal hydroxide, metal peroxide, metal oxide hydrate, metal oxide hydroxide, metal hydrous oxide, basic metal carbonate, basic metal nitrate, or mixtures thereof. For instance, the conventional oxidizer may be CuO, $CO_2O_3$, $CO_3O_4$, $CoFe_2O_4$, $Fe_2O_3$, $MoO_3$, $Bi_2MoO_6$, or mixtures thereof.

The sensitized explosive may be present in the percussion primer at from approximately 35 wt % to approximately 55 wt %. When the percussion primer is to be used in a bullet or other gun cartridge, the explosive may constitute from approximately 25 wt % to approximately 40 wt % of a total weight of the percussion primer. The oxidizer may account for from approximately 20 wt % to approximately 75 wt % of the percussion primer.

The melt binder may be a nonhygroscopic material having a melting point of less than or equal to approximately 120° C., such as a melting point that ranges from approximately 80° C. to approximately 120° C. The melt binder may be a hydrophobic material that has a low viscosity when melted. Examples of melt binders that may be used include, but are not limited to, a wax having a melting point above ambient temperature (approximately 25° C.), trinitrotoluene ("TNT"), poly(3,3-bis(azidomethyl)oxetane) ("poly(BAMO)"), poly (3-azidomethyl-3-methyloxetane) ("poly(AMMO)"), ethyl-3,5-dinitrobenzoate, 1,3,3-trinitroazetine ("TNAZ"), natural gums, or mixtures thereof. The wax may be bees wax, paraffin wax, microcrystalline wax, synthetic waxes, carnauba wax, ozokerite wax, a polyethylene wax, a hydrocarbon wax, or mixtures thereof. Since the melt binder has a low viscosity when melted, the melt binder may flow around the crystals of the sensitized explosive, coating the crystals. The melt binder may also have a strong affinity for the ingredients in the percussion primer and for metal surfaces in which the percussion primer is housed, such as the metal surfaces of ordnance, such as in bullets, grenades, etc. Accordingly, the melt binder may be used to bind together the percussion primer and hold the percussion primer in place in the ordnance. A small amount of the melt binder may be present in the percussion primer. For instance, in centerfire ammunition, the melt binder may be present in the percussion primer at from approximately 0.5 wt % to less than approximately 10 wt %, such as at approximately 1.5 wt %. In rimfire ammunition, the melt binder may be present in the percussion primer at from approximately 0.5 wt % to less than approximately 10 wt %, such as approximately 3 wt %.

The percussion primer may also include optional ingredients, such as an inert filler, diluent, binder, low output explosive, or mixtures thereof. The optional ingredient may be glass, nitrocellulose ("NC"), tetracene, or mixtures thereof. Glass may be used in the percussion primer as an inert filler or diluent that reduces the energy or brisance of the percussion primer. For instance, if a potential formulation of a percussion primer is too energetic to be effectively used to ignite the secondary explosive composition, glass, NC, or mixtures thereof may be added to the percussion primer to reduce its brisance. $Bi_2O_3$ may also be used to reduce the brisance of the percussion primer. If glass is present in the percussion primer, the glass may be ground to a mesh size that ranges from approximately #80 mesh to approximately #120 mesh. The NC used in the percussion primer may be in a fibrous form. In addition to functioning as an inert filler, the NC may function as a binder or reinforcing agent, providing strength to a pellet formed from the percussion primer. Tetracene, which is a sensitive, but low output, explosive, may also be used in the percussion primer. The tetracene may improve reliability of the percussion primer (i.e., reduce the percussion primer failure rate). While these optional ingredients, if present, provide desirable properties to the percussion primer, the percussion primer may be formulated for its intended purpose without using these ingredients.

The percussion primer may be produced by measuring desired amounts of the sensitized explosive and the other ingredients, such as the oxidizer, the melt binder, and any optional ingredients. The other ingredients may be combined with the sensitized explosive, such as in a mixer, to produce the percussion primer composition. Since the sensitized explosive is stored wet, the sensitized explosive may be dried, as previously described, before combining the sensitized explosive with the other ingredients. To achieve a desired consistency of the percussion primer, the ingredients of the percussion primer may be wetted with water or a volatile, nonpolar organic solvent. The organic solvent used to wet the ingredients of the percussion primer may be hexane, heptane, octane, or mixtures thereof. Alternatively, the wet, sensitized explosive may be combined with the other ingredients of the percussion primer, i.e., without first removing the solvent or the solvent and nonsolvent. The resulting percussion primer is not sticky and, therefore, may be easily removed from equipment used to process the percussion primer. Since little material remains on the processing equipment, high yields of the percussion primer may be achieved. In addition, the percussion primer may be easily loaded into gun cartridges or other ordnance. The percussion primer may be formed into a desired shape, such as a pellet, which is selected based on the intended purpose of the percussion primer. Possible shapes of the percussion primer, and methods of fabricating these shapes, are known in the art and, therefore, are not described in detail herein. Any solvents or water may subsequently be removed, producing the percussion primer. However, if water is used to process a percussion primer that includes aluminum, the water may be removed before exposing the percussion primer to elevated temperatures, preventing the aluminum from reacting with the water.

Properties of the percussion primer may depend on relative amounts of each of the ingredients that are present. For instance, combustion properties of the percussion primer may be tailored by varying the relative amounts of the explosive, the sensitizer, the oxidizer, the melt binder, and any optional ingredients to achieve properties that are optimal for the intended purpose of the percussion primer. Since the properties of the percussion primer are tailorable, the percussion primer may be used in a wide variety of ordnance to initiate the secondary explosive composition. Examples of ordnance in which the percussion primer may be used include, but are not limited to, small arms ammunition, grenades, mortars, or detcord initiators. The percussion primer may also be used to initiate or prime mortar rounds, rocket motors, illuminating flares, or signaling flares. For the sake of example only, the percussion primer may be used in a gun cartridge, such as in a centerfire gun cartridge or in a rimfire gun cartridge. The secondary explosive composition that is used in the ordnance may be selected by one of ordinary skill in the art and, therefore, is not discussed in detail herein. For instance, if the ordnance is a gun cartridge, the secondary explosive composition may be a smokeless gunpowder. In a grenade, the percussion primer may ignite a delay charge. In many cases, such as in mortar rounds or medium artillery cartridges, the percussion primer may ignite a booster charge that includes black powder or boron/potassium nitrate with an organic binder.

Figure 2A:
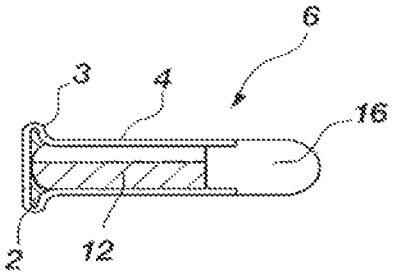
FIGS. 2A and 2B are cross-sectional views of a rimfire gun cartridge.
Figure 3A:
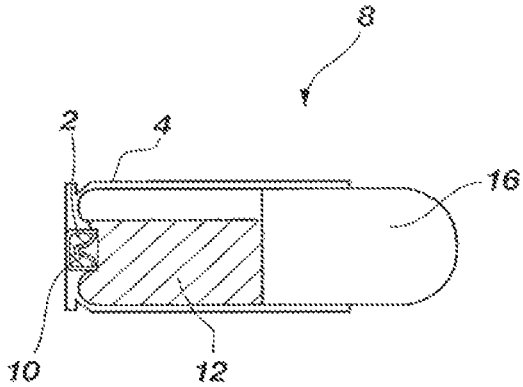
FIGS. 3A and 3B are cross-sectional views of a centerfire gun cartridge.
Figure 2B:
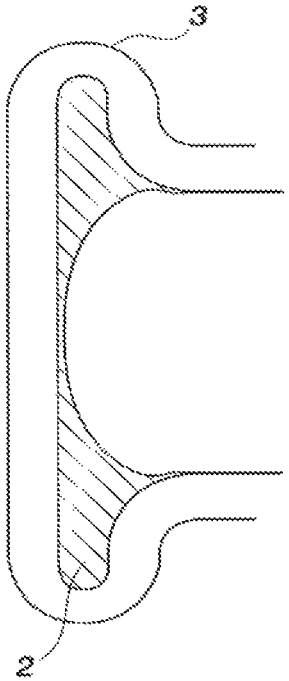
Figure 3B:
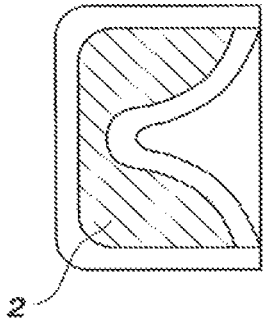

In one embodiment, the percussion primer is used in a centerfire gun cartridge or in a rimfire gun cartridge. Rimfire ignition differs significantly from centerfire ignition and, therefore, a percussion primer that is suitable for use in the centerfire gun cartridge may not provide optimal performance in the rimfire gun cartridge. In small arms using the rimfire gun cartridge, a firing pin strikes a rim of a casing of the gun cartridge. In contrast, the firing pin of small arms using the centerfire gun cartridge strikes a metal cup in the center of the cartridge casing containing the percussion primer. Gun cartridges and cartridge casings are known in the art and, therefore, are not discussed in detail herein. The force or impact of the firing pin may produce a percussive event that is sufficient to detonate the percussion primer in the rimfire gun cartridge or in the centerfire gun cartridge, causing the secondary explosive composition to ignite. As shown in FIGS. 2A and 2B, the percussion primer 2 may be substantially evenly distributed around an interior volume defined by a rim portion 3 of a casing 4 of the rimfire gun cartridge 6. FIG. 2B is an enlarged view of an anterior portion of the rimfire gun cartridge 6. In the centerfire gun cartridge 8, the percussion primer 2 may be positioned in an aperture 10 in the casing 4, as shown in FIGS. 3A and 3B. FIG. 3B is an enlarged view of a component of the centerfire gun cartridge 8. The secondary explosive composition 12 may be positioned substantially adjacent to the percussion primer 2 in the rimfire gun cartridge 6 or in the centerfire gun cartridge 8. When ignited or combusted, the percussion primer 2 may produce sufficient heat and condensing hot particles to ignite the secondary explosive composition 12 to propel projectile 16 from the barrel of the firearm or larger caliber ordnance (such as, without limitation, handgun, rifle, automatic rifle, machine gun, automatic cannon, etc.) in which the cartridge 6 or 8 is disposed. The combustion products of the percussion primer 2 may be environmentally friendly, noncorrosive, and nonabrasive.

Figure 4:
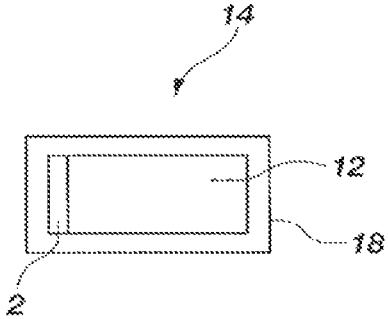
FIG. 4 is a schematic illustration of exemplary ordnance in which a percussion primer of the present invention is used.

As previously mentioned, the percussion primer 2 may also be used in larger ordnance, such as (without limitation) grenades, mortars, or detcord initiators, or to initiate mortar rounds, rocket motors, or other systems including a secondary explosive, alone or in combination with a propellant, all of the foregoing assemblies being encompassed by the term "primer-containing ordnance assembly," for the sake of convenience. In the ordnance, motor or system 14, the percussion primer 2 may be positioned substantially adjacent to the secondary explosive composition 12 in a housing 18, as shown in FIG. 4. Of course, in the instance of a system including a propellant (not shown) the secondary explosive composition 12 would typically be used to initiate the propellant.

The following examples serve to explain embodiments of the present invention in more detail. These examples are not to be construed as being exhaustive or exclusive as to the scope of this invention.

EXAMPLES

Example 1

Sensitized CL-20

77.5% CL-20 and 22.5% Aluminum (Alex®)

CL-20 (50 g) was dissolved in 150 ml of ethyl acetate. The solution was poured into a 400 ml beaker having a magnetic stirring bar and was stirred on a warm hot plate. Alex® aluminum (14.5 g) was poured into the solution, forming a slurry. An air tube was positioned in the beaker to increase the evaporation rate of the ethyl acetate. The ethyl acetate was evaporated until the magnetic stirring bar nearly stuck in the thick slurry that formed upon evaporation of the ethyl acetate. Heptane (50 ml) was added to the beaker and evaporated. An additional amount of heptane (50 ml) was added to the beaker and the beaker removed from the hot plate. After removing the magnetic stirring bar, the sensitized CL-20 was dried by removing the heptane. The dried, sensitized CL-20 was used for testing or was formulated into a percussion primer.

Example 2

Sensitized CL-20

85% CL-20 and 15% Aluminum (Alex)®

A 250-ml round bottom flask having a magnetic stirring bar was charged with 50 g ethyl acetate. CL-20 (8.5 g) was dissolved in the ethyl acetate. Alex® aluminum (1.5 g) was added to the solution, followed by 150 g of heptane. The ethyl acetate and heptane were slowly removed under vacuum at 40° C. using a rotary evaporator. The dried, sensitized CL-20 was used for testing or was formulated into a percussion primer.

Example 3

Sensitized CL-20

70% CL-20 and 30% Aluminum (Alex®)

A 250-ml round bottom flask having a magnetic stirring bar was charged with 50 g ethyl acetate. CL-20 (7.08 g) was dissolved in the ethyl acetate. Alex® aluminum (3.08 g) was added to the solution, followed by 150 g of heptane. The ethyl acetate and heptane were slowly removed under vacuum at 40° C. using a rotary evaporator. The dried, sensitized CL-20 was used for testing or was formulated into a percussion primer.

Example 4

Sensitized CL-20

70% CL-20 and 30% Aluminum (H-5)

A 250-ml round bottom flask having a magnetic stirring bar was charged with 50 g ethyl acetate. CL-20 (1.4 g) was dissolved in the ethyl acetate. Valimet H-5 spherical aluminum (0.6 g) was slowly added to the solution, followed by 160 g of heptane. The ethyl acetate and heptane were slowly removed under vacuum at 40° C. using a rotary evaporator. The dried, sensitized CL-20 was used for testing or was formulated into a percussion primer.

Example 5

Sensitized CL-20

70% CL-20 and 30% Aluminum (H-2)

A 250-ml round bottom flask having a magnetic stirring bar was charged with 50 g ethyl acetate. CL-20 (1.4 g) was dissolved in the ethyl acetate. Valimet H-2 aluminum (0.6 g) was added to the solution, followed by 160 g of heptane. The ethyl acetate and heptane were slowly removed under vacuum at 40° C. using a rotary evaporator. The dried, sensitized CL-20 was used for testing or was formulated into a percussion primer.

Example 6

Sensitized CL-20

85% CL-20 and 15% Melamine

A 250-ml round bottom flask having a magnetic stirring bar was charged with 50 g ethyl acetate. CL-20 (8.5 g) was dissolved in the ethyl acetate. Melamine (1.5 g) was added to the solution, followed by 150 g of heptane. The melamine had an average particle size of approximately 10 μm. The ethyl acetate and heptane were slowly removed under vacuum at 40° C. using a rotary evaporator. The dried, sensitized CL-20 was used for testing or was formulated into a percussion primer.

Example 7

Sensitized CL-20

70% CL-20 and 30% Melamine

A 250-ml round bottom flask having a magnetic stirring bar was charged with 50 g ethyl acetate. CL-20 (7.08 g) was dissolved in the ethyl acetate. Melamine (3.08 g) was added to the solution, followed by 150 g of heptane. The melamine had an average particle size of approximately 10 μm. The ethyl acetate and heptane were slowly removed under vacuum at 40° C. using a rotary evaporator. The dried, sensitized CL-20 was used for testing or was formulated into a percussion primer.

Example 8

Sensitized RDX

70% RDX and 30% Aluminum (Alex®)

A 250-ml round bottom flask having a magnetic stirring bar was charged with 50 g acetone. RDX (7.08 g) was dissolved in the acetone. Alex® aluminum (3.08 g) was added to the solution, followed by 150 g of heptane. The acetone and heptane were slowly removed under vacuum at 40° C. using a rotary evaporator. The dried, sensitized RDX was used for testing or was formulated into a percussion primer.

Example 9

Sensitized RDX

70% RDX and 30% Aluminum (H-2)

A 250-ml round bottom flask having a magnetic stirring bar was charged with 50 g acetone. RDX (1.4 g) was dissolved in the acetone. Valimet H-2 aluminum (0.6 g) was added to the solution, followed by 150 g of heptane. The acetone and heptane were slowly removed under vacuum at 40° C. using a rotary evaporator. The dried, sensitized RDX was used for testing or was formulated into a percussion primer.

Example 10

Sensitized PETN

70% PETN and 30% Melamine

A 250-ml round bottom flask having a magnetic stirring bar was charged with 20 g ethyl acetate. PETN (1.4 g) was dissolved in the ethyl acetate. Melamine (0.6 g) was added to the solution, followed by 60 g of heptane. The melamine had an average particle size of approximately 10 μm. The ethyl acetate and heptane were slowly removed under vacuum at 40° C. using a rotary evaporator. The dried, sensitized PETN was used for testing or was formulated into a percussion primer.

Example 11

Sensitized PETN

70% PETN and 30% Aluminum (Alex®)

A 250-ml round bottom flask having a magnetic stirring bar was charged with 60 g ethyl acetate. PETN (1.4 g) was dissolved in the ethyl acetate. Alex® aluminum (0.6 g) was added to the solution, followed by 100 g of heptane. The ethyl acetate and heptane were slowly removed under vacuum at 40° C. using a rotary evaporator. The dried, sensitized PETN was used for testing or was formulated into a percussion primer.

Example 12

Impact Sensitivity of Sensitized CL-20

The impact sensitivity of sensitized CL-20 was measured using an impact test developed by Allegheny Ballistics Laboratory ("ABL") as known in the art. The impact sensitivity of the sensitized CL-20 was compared to that of unsensitized CL-20 and to a K75 primer. The CL-20 was sensitized with aluminum or with melamine, which was prepared as described in Examples 2, 3, and 6. One formulation of sensitized CL-20 included 70% CL-20 and 30% Alex®, a second formulation of sensitized CL-20 included 85% CL-20 and 15% Alex®, and a third formulation of sensitized CL-20 included 85% CL-20 and 15% melamine. The K75 primer included 39% lead styphnate, 10.8% antimony sulfide, 41% barium nitrate, 2.5% tetracene, 6.3% propellant fines (24:76 nitroglycerin:nitrocellulose), 0.2% gum arabic, and 0.2% gum tragacanth (federal internal specifications allow the ingredients of the K75 primer to vary by +/−3%).

Figure 5:
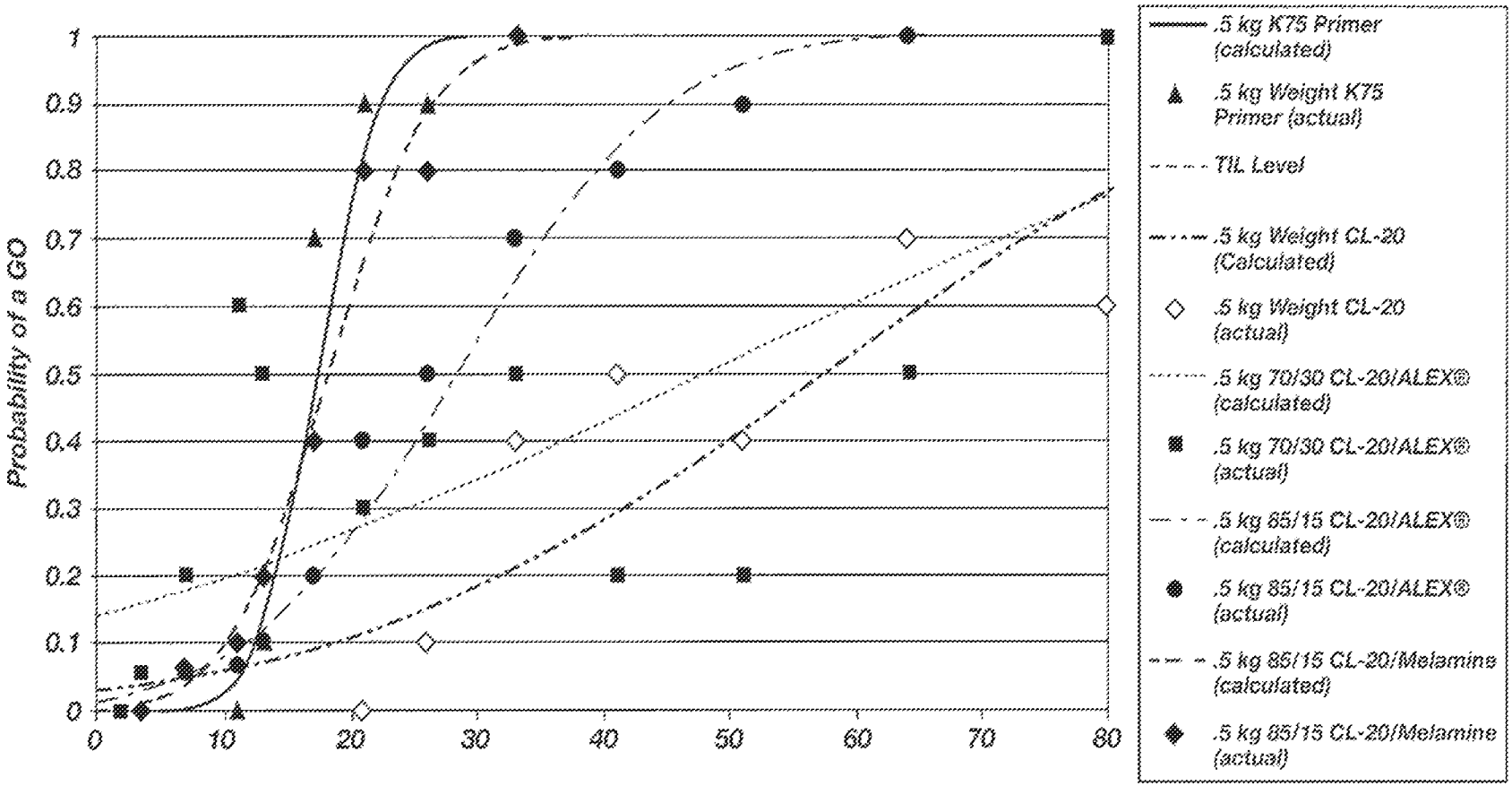
FIGS. 5 and 6 show the results of Allegheny Ballistics Laboratory ("ABL") impact testing conducted on sensitized explosives.

The ABL impact was determined by dropping a 0.5 kg weight from a given height onto a mass (15 mg to 30 mg) of the sensitized CL-20. If the impact between the weight and the sensitized CL-20 caused the sensitized CL-20 to detonate (indicated by the production of smoke, sparks, or ignition), this event was reported as a "GO." The probability of a "GO" as a function of the drop height is shown in FIG. 5 for each of the tested formulations. This data was inputted into a numerical fitting program, yielding the "calculated" plots. The CL-20 sensitized with the aluminum and the CL-20 sensitized with the melamine had comparable impact sensitivity compared to the K75 primer. The CL-20 sensitized with the aluminum and the CL-20 sensitized with the melamine also had comparable or increased impact sensitivity compared to the unsensitized CL-20.

Figure 6:
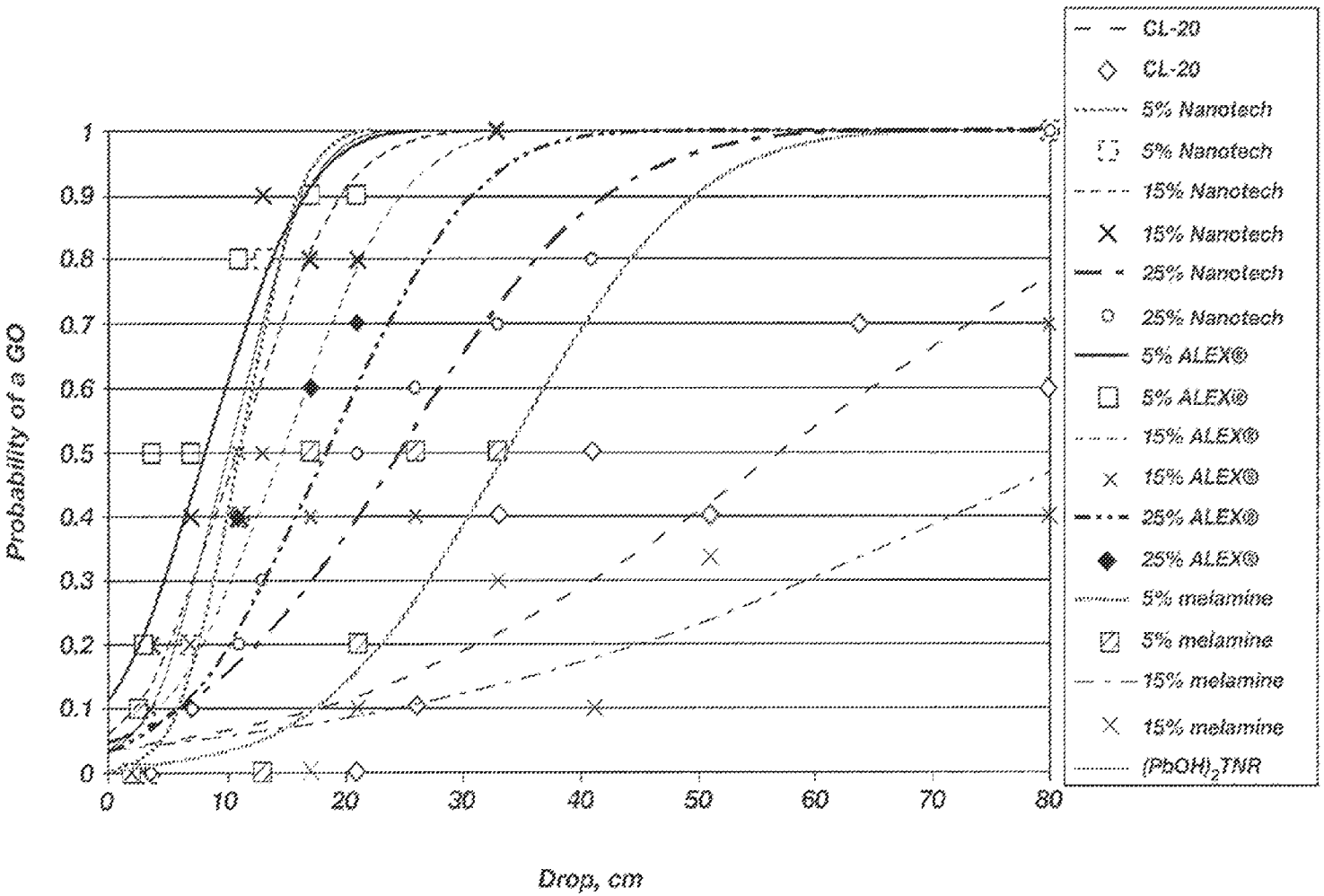

FIG. 6 shows the effect on ABL impact sensitivity of CL-20 sensitized with different types of nanoparticle sized aluminum and with melamine. FIG. 6 also shows the effect of varying the concentration of the sensitizer used in the percussion primer. The CL-20 was sensitized with Nanotech aluminum (available from Nanotech (Austin, Tex.)) and with Alex®. Varying concentrations of the aluminum sensitizers (5 wt %, 15 wt %, and 25 wt % of the sensitized explosive) were tested. The CL-20 was also sensitized with melamine, which was tested in the sensitized explosive at concentrations of 5 wt % and 15 wt %. The impact sensitivity of the sensitized CL-20 was compared to that of unsensitized CL-20 and to that of basic lead styphnate, which is labeled in FIG. 6 as $(PbOH)_2TNR$. The sensitized CL-20 showed increased impact sensitivity compared to the unsensitized CL-20. The sensitized CL-20 also showed comparable or slightly decreased impact sensitivity compared to that of the basic lead styphnate.

Example 13

Formulations of Percussion Primers Used in Centerfire Ammunition

Percussion primers having the formulations shown in Table 1 were produced by sensitizing the CL-20 or PETN with Alex® aluminum. The sensitized explosives were prepared as described in Examples 3 and 11. To form each of the percussion primers, the sensitized CL-20 or the sensitized PETN were combined with the remaining ingredients indicated in Table 1.

TABLE 1

Formulations of Sensitized CL-20 and Sensitized PETN Percussion Primers

| Ingredient | Formulation 1 (wt %) | Formulation 2 (wt %) | Formulation 3 (wt %) | Formulation 4 (wt %) | Formulation 5 (wt %) |
|---|---|---|---|---|---|
| 70% CL-20 sensitized with 30% Alex ® Aluminum | 38.4 | 38.3 | — | 42 | 39 |
| 70% PETN sensitized with 30% Alex ® Aluminum | — | — | 46 | — | — |
| $Bi_2O_3$ | 46.5 | 46.4 | 38.5 | 52 | 46 |
| Ground Glass, #80 mesh size | 9.2 | 8.7 | 9 | — | 13 |
| Fibrous Nitrocellulose | 4.6 | 4.7 | 4.8 | 4.2 | — |
| Ethyl-3,5-dinitrobenzoate | 1.5 | 1.7 | 1.7 | — | — |
| Poly(BAMO) | — | — | — | 1.8 | 1.6 |

Each of Formulations 1-5 was loaded into a centerfire ammunition. The centerfire ammunition was shot to determine the effectiveness of each of the formulations as a percussion primer. Each of the formulations was effective as a percussion primer. As shown by Formulation 4, which lacks ground glass, ground glass is not needed in the percussion primer to achieve effective combustion properties. Nitrocellulose is also not needed in the percussion primer for effective combustion properties, as shown by Formulation 5, which lacks nitrocellulose.

Example 14

Formulation of a Percussion Primer Used in Rimfire Ammunition

A percussion primer having the formulation shown in Table 2 was produced by sensitizing the CL-20 with Alex® aluminum, as described in Example 3. To form the percussion primer, the sensitized CL-20 was combined with the remaining ingredients indicated in Table 2.

TABLE 2

Formulations of Sensitized CL-20 Percussion Primers

| Ingredient | Formulation 1 (wt %) |
|---|---|
| 70% CL-20 sensitized with 30% Alex ® Aluminum | 50 |
| $Bi_2O_3$ | 21 |
| Ground Glass, #120 mesh size | 22 |
| Tetracene | 4 |
| Ethyl-3,5-dinitrobenzoate | 3 |

Formulation 1 was loaded into a rimfire gun cartridge. The rimfire gun cartridge was shot to determine the effectiveness of the formulation as a percussion primer. The formulation was effective as a percussion primer.

While the invention is susceptible to various modifications and alternative forms, specific embodiments have been shown by way of example in the drawings and have been described in detail herein. However, the invention is not intended to be limited to the particular forms disclosed. Rather, the invention is to cover all modifications, equivalents, and alternatives falling within the scope of the invention as defined by the following appended claims and their legal equivalents.

The invention claimed is:

1. A percussion primer composition comprising:

an explosive consisting essentially of at least one moderately insensitive explosive and optionally a low output sensitizing explosive, the at least one moderately insensitive explosive chosen from pentaerythritol tetranitrate ("PETN"), 2,4,6,8,10,12-hexanitro-2,4,6,8,10,12-hexaazatetracyclo $[5.5.0.0.^{5,9}0^{3,11}]$-dodecane ("CL-20"), cyclo-1,3,5-trimethylene-2,4,6-trinitramine ("RDX"), cyclotetramethylene tetranitramine ("HMX"), and mixtures thereof;

a plurality of aluminum particles having an average particle size of about 0.1 microns to about 5 microns; and an oxidizer;

wherein the primer composition is essentially devoid of other explosives except for the optional low output sensitizing explosive.

2. The percussion primer composition of claim 1, wherein the at least one moderately insensitive explosive is precipitated onto the plurality of aluminum particles.

3. The percussion primer composition of claim 1, wherein the oxidizer is chosen from a bismuth compound, a salt of a nitrate, a metal salt of a nitrate, a chlorate, a perchlorate, a metal oxide, a metal hydroxide, a metal peroxide, a metal oxide hydrate, a metal oxide hydroxide, a metal hydrous oxide, a basic metal carbonate, a basic metal nitrate, or mixtures thereof.

4. The percussion primer composition of claim 3, wherein the oxidizer is chosen from bismuth trioxide ($Bi_2O_3$), bismuth subnitrate ($BiONO_3$), bismuth tetroxide ($Bi_2O_4$), bismuth sulfide ($B_2S_3$), barium nitrate ($Ba(NO_3)_2$), cesium nitrate ($CsNO_3$), potassium nitrate ($KNO_3$), ammonium nitrate, potassium chlorate ($NH_4NO_3$), potassium perchlorate ($KClO_4$), ammonium perchlorate ($NH_4ClO_4$), copper oxide (CuO), cobalt(II) oxide ($CO_2O_3$), cobalt(II,III) oxide ($CO_3O_4$), cobalt ferrite ($COFe_2O_4$), iron(III) oxide ($Fe_2O_3$), Molybdenum trioxide ($MoO_3$), bismuth molybdate ($Bi_2MoO_6$), or mixtures thereof.

5. The percussion primer composition of claim 1, further comprising a melt binder having a melting point of less than about 120° C.

6. The percussion primer composition of claim 1, further comprising the low output sensitizing explosive, the low output sensitizing explosive comprising tetracene.

7. The percussion primer composition of claim 1, wherein the at least one moderately insensitive explosive and the plurality of aluminum particles comprise from about 35 wt-% to about 55 wt-% of the percussion primer.

8. The percussion primer composition of claim 1, wherein the oxidizer comprises from about 20 wt-% to about 75 wt-% of the percussion primer.

9. The percussion primer composition of claim 1 disposed within an ordnance chosen from a centerfire gun cartridge, a fimfire gun cartridge, and a primer-containing ordance assembly.

10. The percussion primer composition of claim 9 disposed within the ordnance, wherein the ordnance contains a secondary explosive that is capable of being initiated by the percussion primer composition.

11. A percussion primer composition comprising:

an explosive substantially free of heavy metals consisting essentially of at least one moderately insensitive explosive having an impact sensitivity in the range from about 0.3 kp m to about 0.75 kp m and optionally a low output sensitizing explosive having an impact sensitivity less than about 0.3 kp m;

a plurality of aluminum particles having an average particle size of about 0.1 microns to about 5 microns; and an oxidizer;

wherein the percussion primer composition is essentially devoid of other explosives except for the optional low output sensitizing explosive.

12. The percussion primer composition of claim 11, wherein the at least one moderately insensitive explosive is precipitated onto the plurality of aluminum particles.

13. The percussion primer composition of claim 11, wherein the oxidizer is a bismuth compound.

14. The percussion primer composition of claim 13, wherein the bismuth compound is chosen from bismuth trioxide ($Bi_2O_3$), bismuth subnitrate ($BiONO_3$), bismuth tetroxide ($Bi_2O_4$), bismuth sulfide ($B_2S_3$), or mixtures thereof.

15. The percussion primer composition of claim 13, wherein the bismuth compound comprises from about 20 wt-% to about 75 wt-% of the percussion primer.

16. The percussion primer composition of claim 15, wherein the at least one moderately insensitive explosive and the plurality of aluminum particles comprise from about 35 wt-% to about 55 wt-% of the percussion primer.

17. The percussion primer composition of claim 11, wherein the oxidizer is chosen from a salt of a nitrate, a metal salt of a nitrate, a chlorate, a perchlorate, a metal oxide, a metal hydroxide, a metal peroxide, a metal oxide hydrate, a metal oxide hydroxide, a metal hydrous oxide, a basic metal carbonate, a basic metal nitrate, or mixtures thereof.

18. The percussion primer composition of claim 17, wherein the oxidizer is chosen from barium nitrate ($Ba(NO_3)_2$), cesium nitrate ($CsNO_3$), potassium nitrate ($KNO_3$), ammonium nitrate, potassium chlorate ($NH_4NO_3$), potassium perchlorate ($KClO_4$), ammonium perchlorate ($NH_4ClO_4$), copper oxide (CuO), cobalt(II) oxide ($CO_2O_3$), cobalt(II,III) oxide ($CO_3O_4$), cobalt ferrite ($COFe_2O_4$), iron (III) oxide ($Fe_2O_3$), Molybdenum trioxide ($MoO_3$), bismuth molybdate ($Bi_2MoO_6$), or mixtures thereof.

19. The percussion primer composition of claim 11, further comprising a melt binder having a melting point of less than about 120° C.

20. The percussion primer composition of claim 11, further comprising the low output sensitizing explosive.

21. The percussion primer composition of claim 20, wherein the low output sensitizing explosive comprises tetracene.

22. The percussion primer composition of claim 11, wherein the at least one moderately insensitive explosive and the plurality of aluminum particles comprise from about 35 wt-% to about 55 wt-% of the percussion primer.

23. The percussion primer composition of claim 11, wherein the oxidizer comprises from about 20 wt-% to about 75 wt-% of the percussion primer.

24. The percussion primer composition of claim 11, further comprising an inert filler, wherein the inert filler is glass.

25. The percussion primer composition of claim 11 disposed within an ordnance chosen from a centerfire gun cartridge, a timbre gun cartridge, and a primer-containing ordance assembly.

26. The percussion primer composition of claim 25 disposed within the ordnance, wherein the ordnance contains a secondary explosive that is capable of being initiated by the percussion primer composition.

27. A percussion primer composition comprising:

an explosive substantially free of heavy metals consisting essentially of at least one moderately insensitive explosive having an impact sensitivity in the range from about 0.3 kp m to about 0.75 kp in and optionally a low output sensitizing explosive having an impact sens't sit r less than about 0.3 kp m;

a sensitizer having an average particle size of about 0.1 microns to about 5 microns; and an oxidizer;

wherein the percussion primer composition is essentially devoid of other explosives except for the optional low output sensitizing explosive.

28. The percussion primer composition of claim 27, wherein the at least cine moderately insensitive explosive is precipitated onto the sensitizer.

29. The percussion primer composition of claim 27, wherein the sensitizer has an average particle size of about 2 microns to about 5 microns.

30. The percussion primer composition of claim 27, wherein the sensitizer has an average particle size of about 0.5 microns to about 5 microns.

31. The percussion primer composition of claim 27, wherein the sensitizer comprises melamine, the melamine having an average particle size of about 2 microns to about 5 microns.

32. The percussion primer composition of claim 27, wherein the sensitizer comprises aluminum, the aluminum having an average particle size of about 0.5 microns to about 5 microns.

33. The percussion primer composition of claim 27, wherein the oxidizer is a bismuth compound.

34. The percussion primer composition of claim 33, wherein the bismuth compound is chosen from bismuth trioxide ($Bi_2O_3$), bismuth subnitrate ($BiONO_3$), bismuth tetroxide ($Bi_2O_4$), bismuth sulfide ($B_2S_3$), or mixtures thereof.

35. The percussion primer composition of claim 33, wherein the bismuth compound comprises from about 20 wt-% to about 75 wt-% of the percussion primer.

36. The percussion primer composition of claim 35, wherein the at least one moderately insensitive explosive and the sensitizer comprise from about 35 wt-% to about 55 wt-% of the percussion primer.

37. The percussion primer composition of claim 27, wherein the oxidizer is chosen from a salt of a nitrate, a metal salt of a nitrate, a chlorate, a perchlorate, a metal oxide, a metal hydroxide, a metal peroxide, a metal oxide hydrate, a metal oxide hydroxide, a metal hydrous oxide, a basic metal carbonate, a basic metal nitrate, or mixtures thereof.

38. The percussion primer composition of claim 37, wherein the oxidizer is chosen from barium nitrate ($Ba(NO_3)_2$), cesium nitrate ($CsNO_3$), potassium nitrate ($KNO_3$), ammonium nitrate, potassium chlorate ($NH_4NO_3$), potassium perchlorate ($KClO_4$), ammonium perchlorate ($NH_4ClO_4$), copper oxide ($CuO$), cobalt(II) oxide ($CO_2O_3$), cobalt(II,III) oxide ($CO_3O_4$), cobalt ferrite ($COFe_2O_4$), iron (III) oxide ($Fe_2O_3$), Molybdenum trioxide ($MoO_3$), bismuth molybdate ($Bi_2MoO_6$), or mixtures thereof.

39. The percussion primer composition of claim 27, further comprising a melt binder having a melting point of less than about 120° C.

40. The percussion primer composition of claim 27, further comprising the low output sensitizing explosive.

41. The percussion primer composition of claim 40, wherein the low output sensitizing explosive comprises tetracene.

42. The percussion primer composition of claim 27, wherein the at least one moderately insensitive explosive and the sensitizer comprise from about 35 wt-% to about 55 wt-% of the percussion primer.

43. The percussion primer composition of claim 27, wherein the oxidizer comprises from about 20 wt-% to about 75 wt-% of the percussion primer.

44. The percussion primer composition of claim 27, further comprising an inert filler, wherein the inert filler is glass.

* * * * *

UNITED STATES PATENT AND TRADEMARK OFFICE

CERTIFICATE OF CORRECTION

PATENT NO. : 8,460,486 B1
APPLICATION NO. : 13/477750
DATED : June 11, 2013
INVENTOR(S) : Harold E. Johnston et al.

It is certified that error appears in the above-identified patent and that said Letters Patent is hereby corrected as shown below:

On the Title Page, item (75) Inventors:

Harold E. Johnston, Radford, VA (US);
Kristin F. Warner, Ogden, UT (US);
Reed J. Blau, Richmond, UT (US);
Scott K. Lusk, Clarkston, UT (US)

should be

Harold E. Johnston, Radford, VA (US);
Kirstin F. Warner, Ogden, UT (US);
Reed J. Blau, Richmond, UT (US);
Scott K. Lusk, Clarkston, UT (US)

Signed and Sealed this
Third Day of December, 2013

Margaret A. Focarino

Margaret A. Focarino
*Commissioner for Patents of the United States Patent and Trademark Office*